US009421417B2

(12) United States Patent
Hsu

(10) Patent No.: US 9,421,417 B2
(45) Date of Patent: Aug. 23, 2016

(54) BICYCLE TRAINER

(71) Applicant: Giant Manufacturing Co., Ltd., Taichung (TW)

(72) Inventor: Hsaio-Wen Hsu, Taichung (TW)

(73) Assignee: Giant Manufacturing Co., Ltd., Taichung (TW)

( * ) Notice: Subject to any disclaimer, the term of this patent is extended or adjusted under 35 U.S.C. 154(b) by 0 days.

(21) Appl. No.: 14/571,712

(22) Filed: Dec. 16, 2014

(65) Prior Publication Data

US 2016/0101313 A1 Apr. 14, 2016

(30) Foreign Application Priority Data

Oct. 14, 2014 (TW) ..... 103135517 A

(51) Int. Cl.

| | |
|---|---|
| ***A63B 22/06*** | (2006.01) |
| ***A63B 21/015*** | (2006.01) |
| ***A63B 21/005*** | (2006.01) |
| ***A63B 21/008*** | (2006.01) |
| ***A63B 69/16*** | (2006.01) |
| ***A63B 21/012*** | (2006.01) |
| ***A63B 21/22*** | (2006.01) |

(52) U.S. Cl.

CPC ..... *A63B 22/0605* (2013.01); *A63B 21/0053* (2013.01); *A63B 21/0057* (2013.01); *A63B 21/0081* (2013.01); *A63B 21/0088* (2013.01); *A63B 21/015* (2013.01); *A63B 21/0125* (2013.01); *A63B 21/225* (2013.01); *A63B 69/16* (2013.01)

(58) Field of Classification Search

CPC ..... A63B 69/16; A63B 2069/164; A63B 2069/165

See application file for complete search history.

(56) References Cited

U.S. PATENT DOCUMENTS

| | | | | | |
|---|---|---|---|---|---|
| 330,430 | A * | 11/1885 | Seiler | A63B 69/16 211/22 |
| 4,674,742 | A * | 6/1987 | Baatz | A63B 69/16 482/59 |
| 5,944,637 | A * | 8/1999 | Stickler | A63B 69/16 482/112 |
| 2003/0073546 | A1 | 4/2003 | Lassanske et al. | |
| 2003/0087731 | A1 | 5/2003 | Huang | |

(Continued)

FOREIGN PATENT DOCUMENTS

| | | |
|---|---|---|
| JP | S63148359 | 9/1988 |
| TW | I273915 | 2/2007 |
| TW | 201343226 | 11/2013 |

OTHER PUBLICATIONS

"Office Action of Europe Counterpart Application", issued on Mar. 1, 2016, p. 1-p. 6.

(Continued)

*Primary Examiner* — Loan H Thanh
*Assistant Examiner* — Rae Fischer
(74) *Attorney, Agent, or Firm* — J.C. Patents

(57) ABSTRACT

A bicycle trainer is adapted to be arranged with a bicycle to simulate riding a bicycle on an outdoor road. The bicycle includes a stand, a roller, a first resistance source and a second resistance source. The stand is adapted to support the bicycle. The roller is pivoted to the stand and is adapted to contact a bicycle wheel of the bicycle. The first resistance source is coupled to the roller and provides resistance to the bicycle wheel via the roller. The second resistance source is coupled to the roller and provides resistance to the bicycle wheel via the roller.

19 Claims, 7 Drawing Sheets

(56) References Cited

U.S. PATENT DOCUMENTS

| | | | |
|---|---|---|---|
| 2007/0173392 | A1 | 7/2007 | Stanford |
| 2011/0195818 | A1 | 8/2011 | Schroeder et al. |
| 2013/0123070 | A1 | 5/2013 | Baatz |

OTHER PUBLICATIONS

"Office Action of Taiwan Counterpart Application", issued on May 5, 2016, p1-p7.

* cited by examiner

BICYCLE TRAINER

CROSS-REFERENCE TO RELATED APPLICATION

This application claims the priority benefit of Taiwan application serial no. 103135517, filed on Oct. 14, 2014. The entirety of the above-mentioned patent application is hereby incorporated by reference herein and made a part of this specification.

BACKGROUND OF THE INVENTION

1. Field of the Invention

The invention relates to a bicycle, and particularly relates to a bicycle trainer.

2. Description of Related Art

When unable to perform training on an outdoor road due to weather conditions, bicycle cyclists or enthusiasts may use a bicycle arranged with a bicycle trainer to simulate riding on an outdoor road. Currently on the market, bicycle trainers normally only have a single resistance source, for example a wind resistance type resistance source, a magnetic resistance type resistance source or a fluid resistance type resistance source. Single resistance sources are able to simulate only one type of riding situation, for example by increasing the gradient of the riding condition or the resistance when riding with head wind or increasing the training intensity, and will result in an inaccurate simulation, resulting in an unfamiliar feel to the rider.

SUMMARY OF THE INVENTION

The invention provides a bicycle trainer, adapted to be arranged with a bicycle to simulate riding a bicycle on an outdoor road.

A bicycle trainer of the invention is adapted to be arranged with a bicycle to simulate riding a bicycle on an outdoor road. The bicycle trainer includes a stand, a roller, a first resistance source and a second resistance source. The stand is adapted to support the bicycle. The roller is pivoted to the stand and adapted to contact a bicycle wheel of the bicycle. The first resistance source is coupled to the roller, and provides resistance to the bicycle wheel via the roller. The second resistance source is coupled to the roller, and provides resistance to the bicycle wheel via the roller. Furthermore, the first resistance source, the second resistance source and the roller may be coupled to a same rotation axis, to allow the resistance to be transmitted more directly, making the riding experience better.

According to the above, in the invention, dual resistance sources are disposed to simulate riding a bicycle on an outdoor road, therefore the parameters for the resistance sources may be set according to realistic requirements, for example a resistance source designed according to different gradients or a resistance source designed for wind resistance according to different speeds or a resistance source designed according to training intensity.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
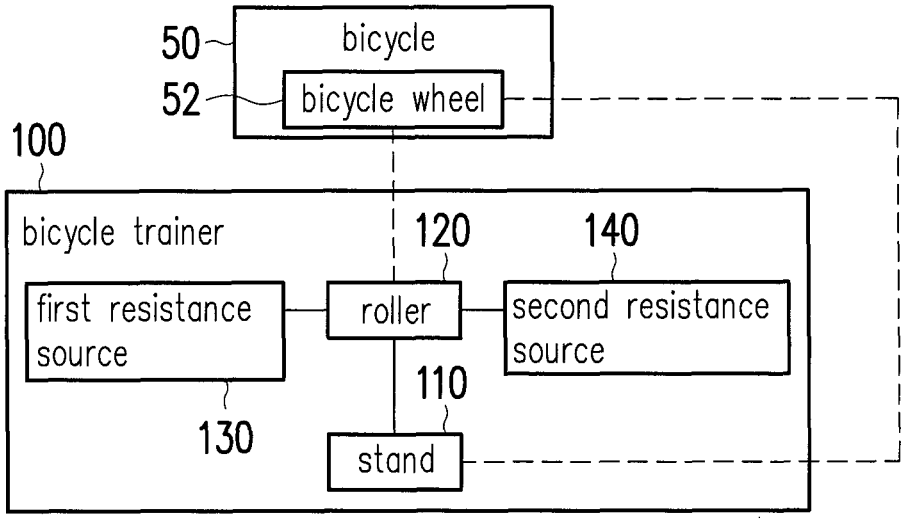
FIG. 1 is a block diagram illustrating of a bicycle trainer according to an embodiment of the invention.

Reference will now be made in detail to the present preferred embodiments of the invention, examples of which are illustrated in the accompanying drawings. Wherever possible, the same reference numbers are used in the drawings and the description to refer to the same or like parts.

Figure 2:
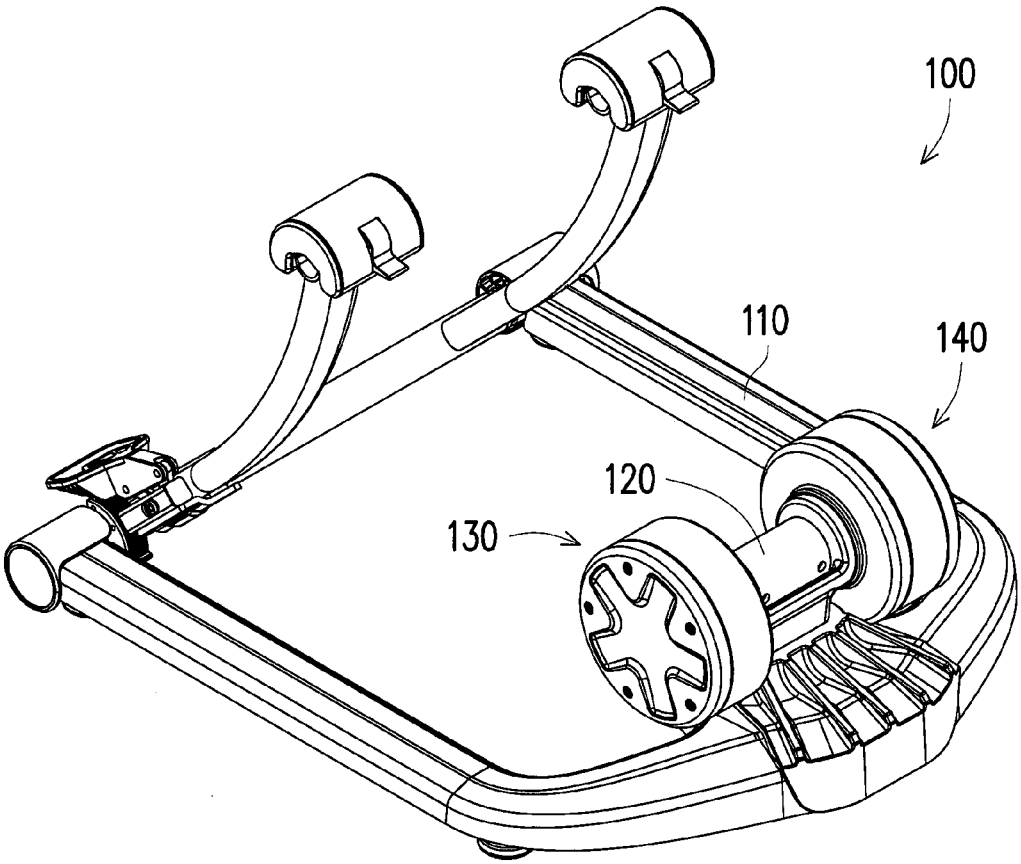
FIG. 2 is a three dimensional view illustrating the bicycle trainer of FIG. 1.
Figure 3:
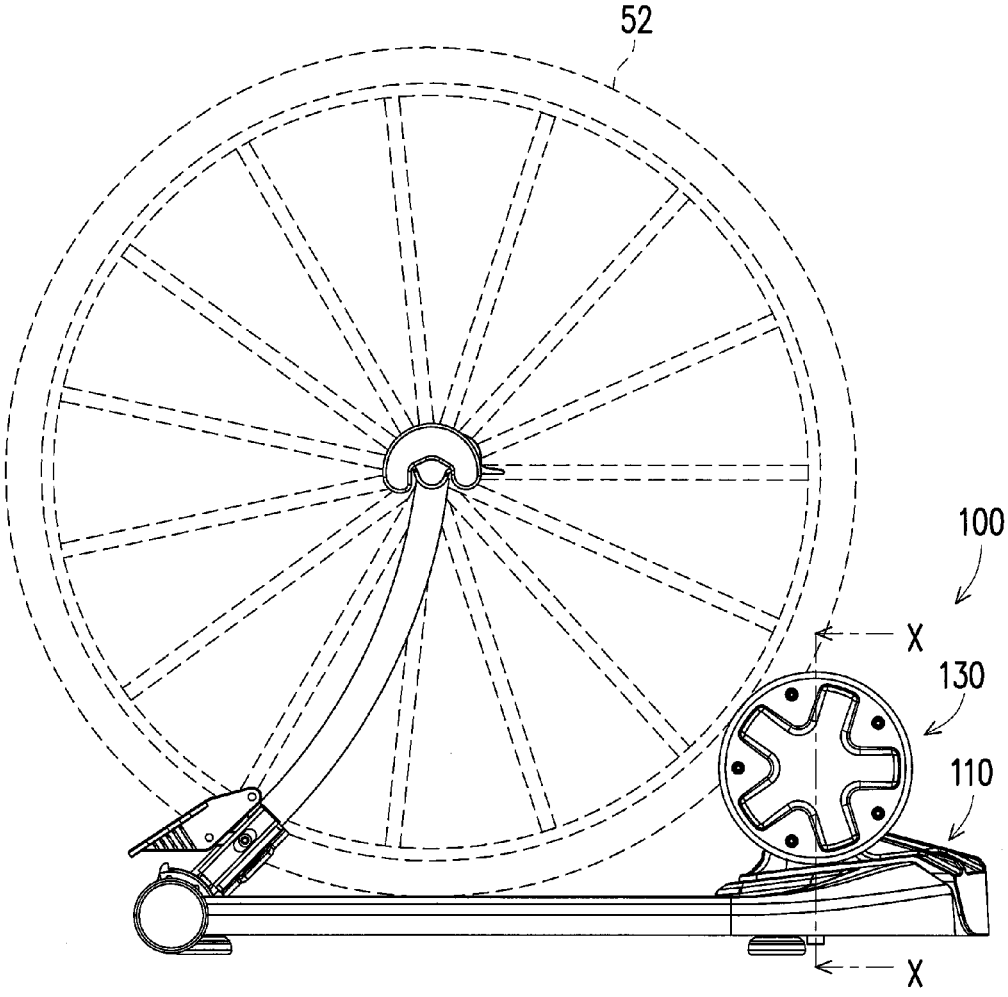
FIG. 3 is a side view illustrating the bicycle trainer of FIG. 2.

Referring to FIG. 1, FIG. 2 and FIG. 3, in the present embodiment, a bicycle trainer 100 is adapted to be arranged with a bicycle 50 to simulate riding a bicycle 50 on an outdoor road. The bicycle trainer 100 includes a stand 110, a roller 120, a first resistance source 130 and a second resistance source 140. The stand 110 is adapted to support the bicycle 50, and particularly to support a bicycle wheel 52 of the bicycle 50. The roller 120 is pivoted to the stand 110 and adapted to contact a bicycle wheel 52 of the bicycle 50. The first resistance source 130 is coupled to the roller 120 and provides resistance to the bicycle wheel 52 via the roller 120. The second resistance source 140 is coupled to the roller 120 and provides resistance to the bicycle wheel 52 via the roller 120.

In an embodiment, the first resistance source 130 may be a wind resistance type resistance source, a magnetic resistance type resistance source, a fluid resistance type resistance source or a friction type resistance source. The second resistance source 140 is a wind resistance type resistance source, a magnetic resistance type resistance source, a fluid resistance type resistance source or a friction type resistance source. In an embodiment, the first resistance source 130 and the second resistance source 140 are respectively located at the two ends of the roller 120, therefore balancing of the weight may be achieved. In an embodiment, the first resistance source 130 is an automatic adjusting resistance source, and the second resistance source 140 is a manual adjusting resistance source.

Figure 4A:
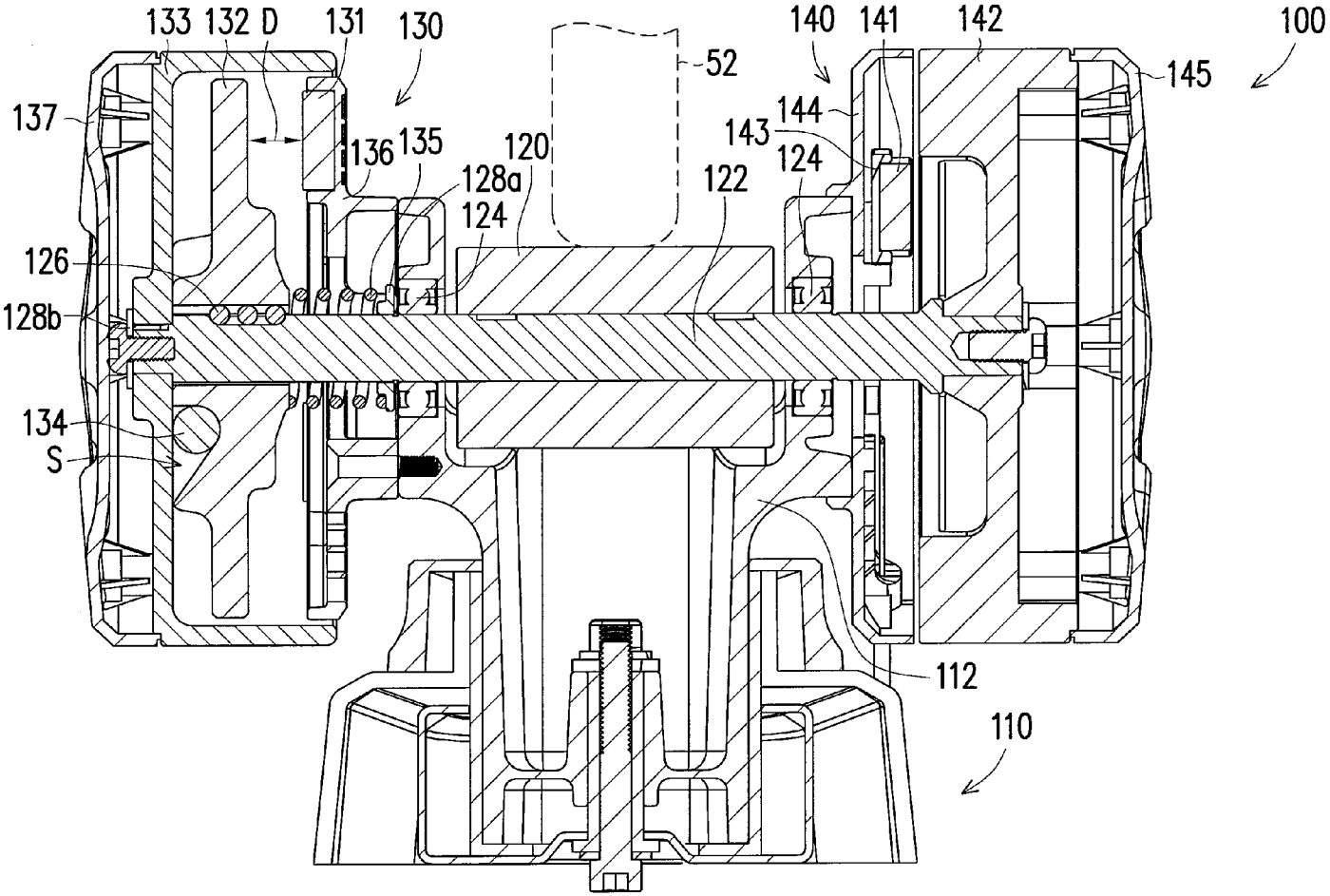
FIG. 4A is a partial cross-sectional view illustrating the bicycle trainer of FIG. 3 in a resting state along the line X-X.

Referring to FIG. 2, FIG. 3 and FIG. 4A, in the present embodiment, the first resistance source 130 uses a magnetic resistance type resistance source, and in particular is a magnetic type resistance source which uses the eddy current effect. The first resistance source 130 may include a magnetic fixing component 131 and a first non-magnetic metal rotating component 132. The magnetic fixing component 131 is fixed to a supporting part 112 of the stand 110. The roller 120 is coupled to a rotation axis 122, the rotation axis 122 is pivoted to the stand 110 through a plurality of bearings 124, and the first non-magnetic metal rotating component 132 is coupled to the roller 120 through the rotation axis 122. The rotating first non-magnetic metal rotating component 132 and the magnetic fixing component 131 mutually interact producing a magnetic resistance, and is provided to the roller 120. In the present embodiment, the magnetic fixing component 131 is a magnetic component 131*a* (magnet, for example), and the first non-magnetic metal rotating component 132 may be a magnetism sensing flywheel (flywheel of zinc alloy, aluminum alloy, copper alloy, or stainless steel material, for example).

Figure 4B:
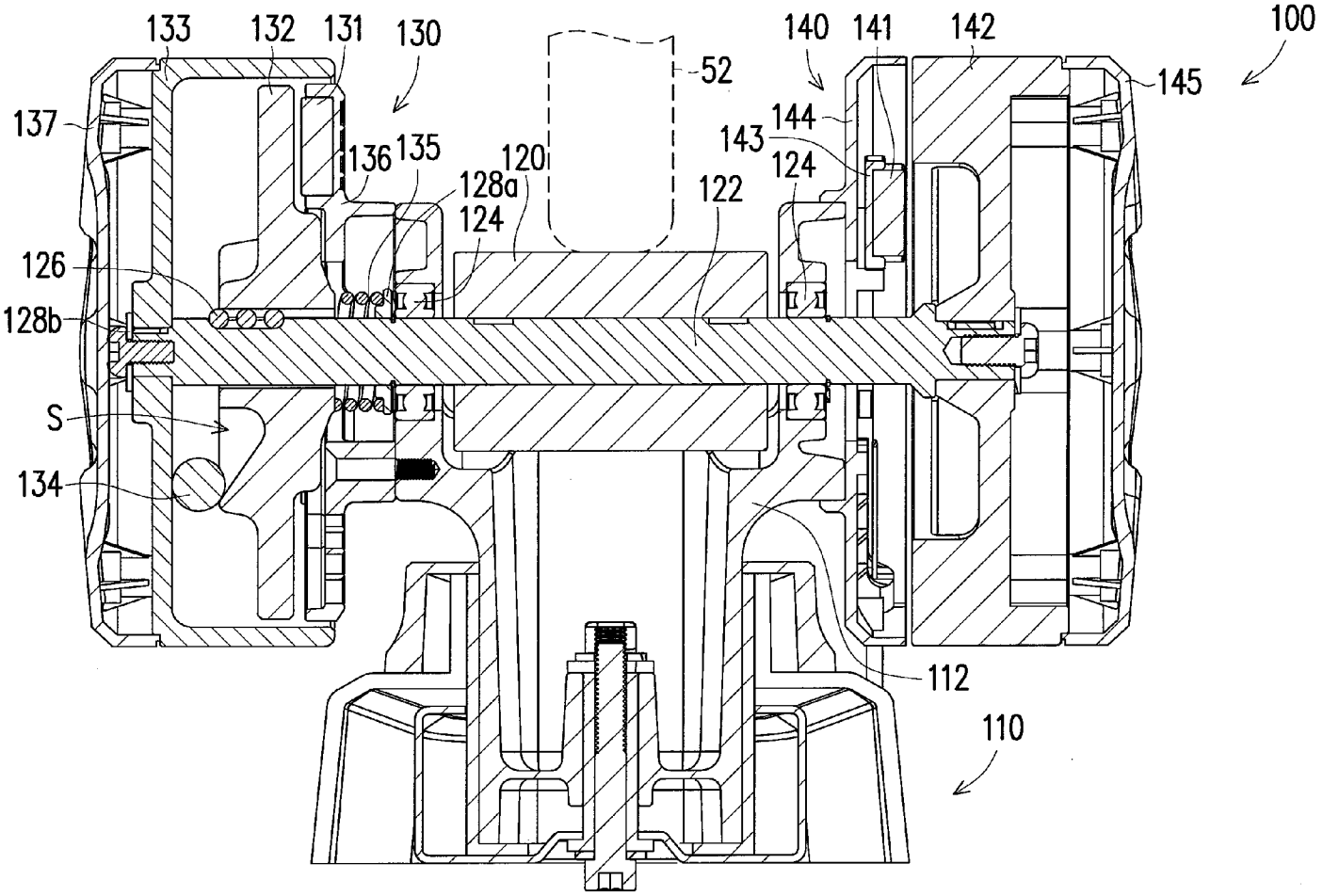
FIG. 4B is a partial cross-sectional view illustrating the bicycle trainer of FIG. 4A in an active state.

Referring to FIG. 4A and FIG. 4B, in the present embodiment, in order to allow the first resistance source 130 to automatically vary the provided resistance according to the rotation speed of the roller 120 (namely bicycle wheel 52), the first resistance source 130 may further include a restrictive rotating component 133 and a plurality of rolling components 134 (for example, a plurality of balls). The restrictive rotating component 133 may be coupled to the roller 120 through the rotation axis 122, and construes a plurality of paths S with the first non-magnetic metal rotating component 132. The rolling components 134 are respectively located in the paths S. When the rotation speed of the first non-magnetic metal rotating component 132 and the restrictive rotating component 133 changes, the rolling components 134 move along the paths S due to the influence of centrifugal force, allowing the first non-magnetic metal rotating component 132 to move with respect to the restrictive rotating component 133 to adjust an interacting distance D between the magnetic fixing component 131 and the first non-magnetic metal rotating component 132. It should be noted, the magnetic resistance produced by the eddy current effect is inversely proportional to the interacting distance D squared. The smaller the interacting distance D, the larger the magnetic resistance produced by the mutual interaction of the magnetic fixing component 131 and the first non-magnetic metal rotating component 132, as shown in FIG. 4B.

Referring to FIG. 4A and FIG. 4B, in the present embodiment, a plurality of rolling components 126 (balls, for example) are arranged between the first non-magnetic metal rotating component 132 and the rotation axis 122. The rolling components 126 are linearly arranged at the periphery of the rotation axis 122, and respectively located in particular grooves, to set the moving direction of the first non-magnetic metal rotating component 132 with respect to the rotation axis 122.

Referring to FIG. 4A and FIG. 4B, in the present embodiment, the first resistance source 130 further includes a restoring component 135. The restoring component 135 may restore the first non-magnetic metal rotating component 132 with respect to the restrictive rotating component 133. When the rotation speed of the first non-magnetic metal rotating component 132 and the restrictive rotating component 133 decreases, the restoring component 135 restores the first non-magnetic metal rotating component 132, and increases the interacting distance D between the first non-magnetic metal rotating component 132 and the magnetic fixing component 131, as shown in FIG. 4A, therefore decreasing the magnetic resistance produced by the mutual interaction of the magnetic fixing component 131 and the first non-magnetic metal rotating component 132. The restoring component 135 may be achieved by a spring force or by mutual magnetic repulsion, therefore the restoring component 135 may be an elastic component or a pair of magnetic components. In the present embodiment, the restoring component 135 for example is a spring, arranged on the rotation axis 122, and may set the movement range of the first non-magnetic metal rotating component 132 and the restoring component 135 with respect to the rotation axis 122 by an inner stop ring 128*a* and an outer stop ring 128*b* arranged on the rotation axis 122.

Referring to FIG. 4A, in the present embodiment, the first resistance source 130 further includes an inner cover 136, mutually interacting with the first non-magnetic metal rotating component 132 to produce a magnetic resistance. In addition, the first resistance source 130 further includes a first outer cover 137. The first outer cover 137 is fixed to the restrictive rotating component 133, and rotates together with the restrictive rotating component 133, the first non-magnetic metal rotating component 132 and the rotation axis 122.

Figure 5A:
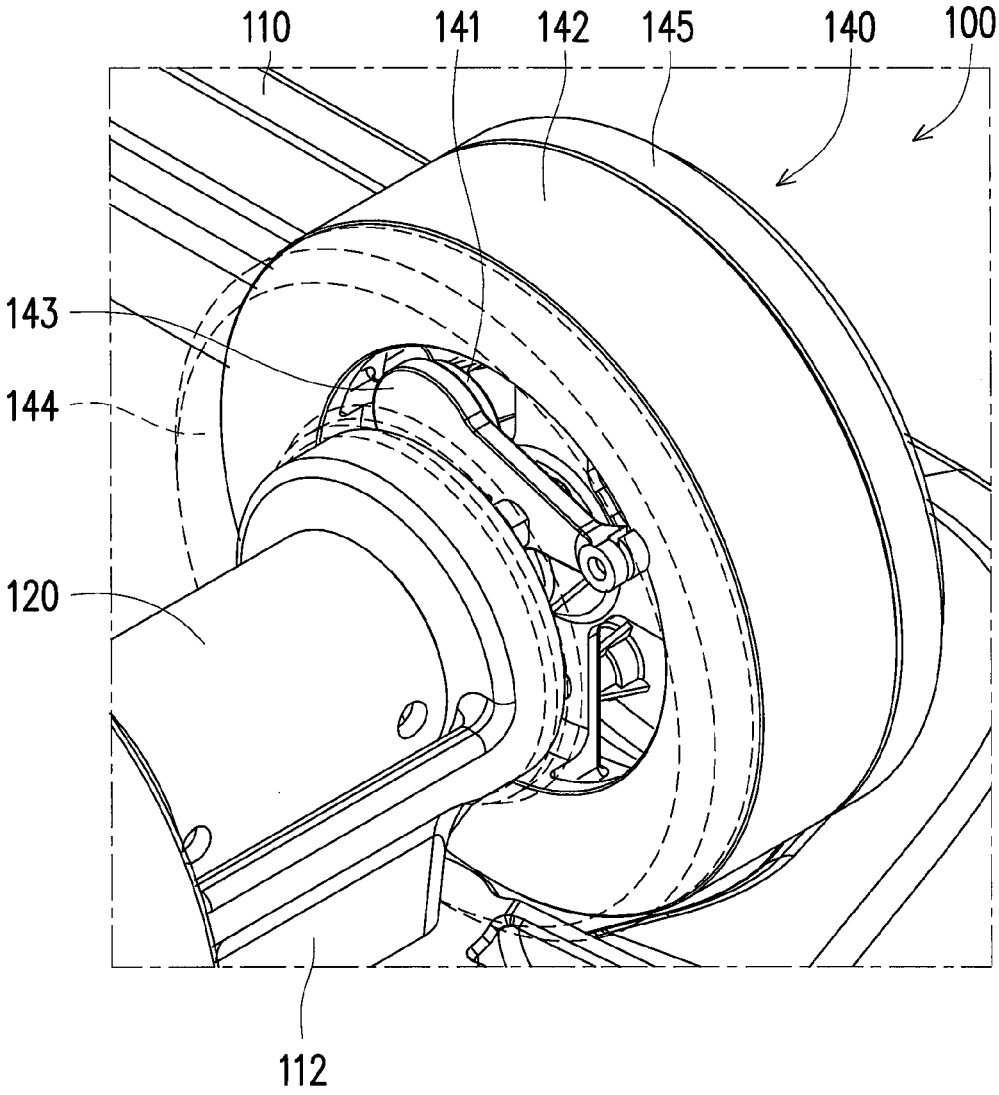
FIG. 5A is a three dimensional partial exploded view illustrating a second resistance source of the bicycle trainer of FIG. 3 when a magnetic resistance is not increased.
Figure 5B:
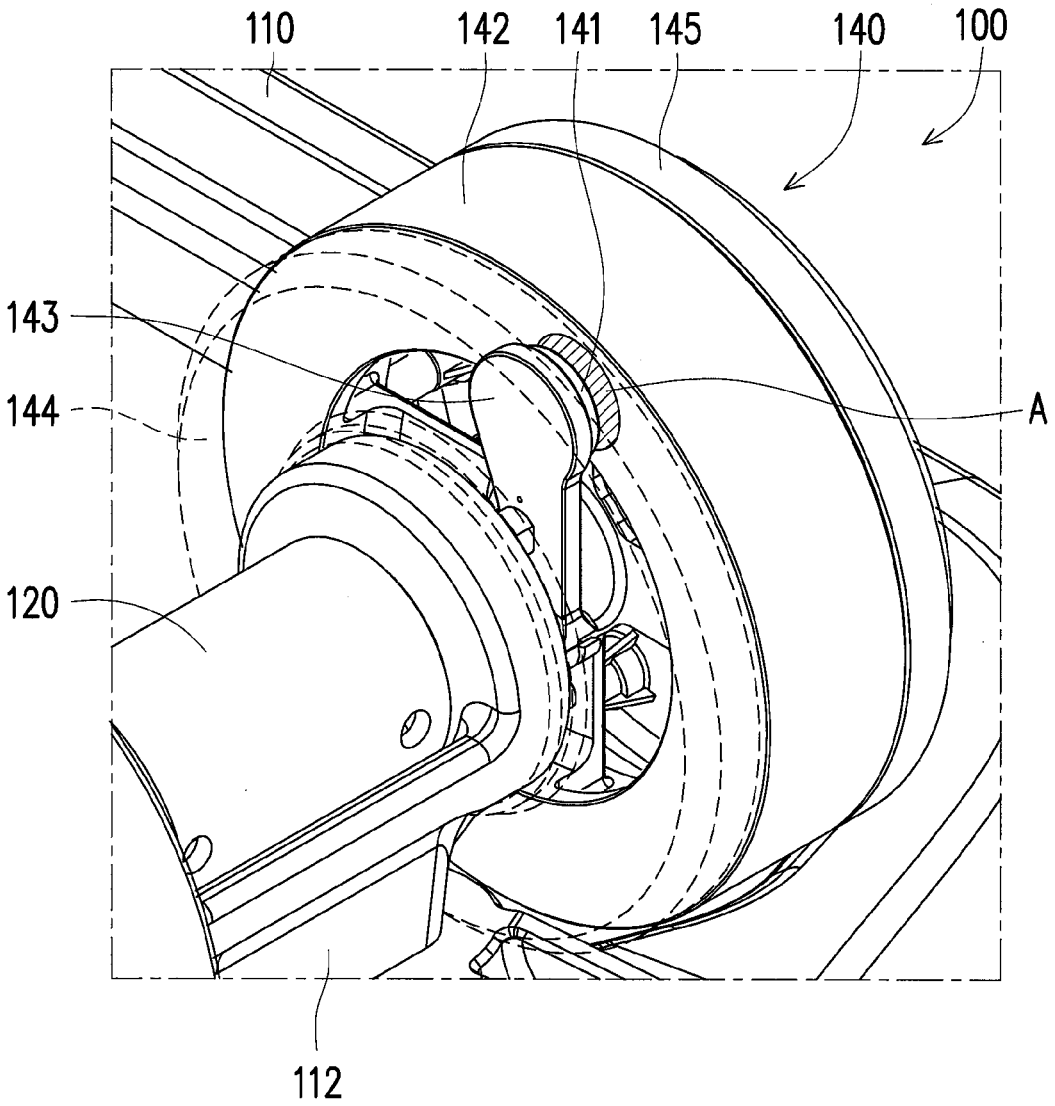
FIG. 5B is a three dimensional partial exploded view illustrating a second resistance source of the bicycle trainer of FIG. 5A when a magnetic resistance is increased.

Referring to FIG. 5A and FIG. 5B, in the present embodiment, the second resistance source 140 also uses a magnetic resistance type resistance source, and in particular is a magnetic type resistance source using the eddy current effect. The second resistance source 140 may include a magnetism adjusting component 141, a second non-magnetic metal rotating component 142 and an adjustment assembly 143. The magnetism adjusting component 141 may be movably attached to the stand 110. The second non-magnetic metal rotating component 142 is coupled to the roller 120 by being coupled to the rotation axis 122, and mutually interacting with the magnetism adjusting component 141 to produce a magnetic resistance. The adjustment assembly 143 for example is a manual wire controlled adjustment assembly and is connected to the magnetism adjusting component 141, and used to adjust the interacting area A between the magnetism adjusting component 141 and the second non-magnetic metal rotating component 142. When the first resistance source 130, the second resistance source 140 and the roller 120 are coupled to the same rotation axis 122, the resistance is transmitted more directly, making the riding experience better.

Referring to FIG. 4A, in the present embodiment, the second resistance source 140 further includes a second inner cover 144 and a second outer cover 145. The second inner cover 144 is fixed to the supporting part 112 of the stand 110, and the magnetism adjusting component 141 may be movably (such as rotatably) attached to the supporting part 112 of the stand 110. The second outer cover 145 is fixed to the second non-magnetic metal rotating component 142, and rotates together with the second non-magnetic metal rotating component 142 and the rotation axis 122.

In summary, in the invention, dual resistance sources are disposed to simulate riding a bicycle on an outdoor road, therefore the type of resistance source may be set according to realistic requirements. In addition, one resistance source may be set automatically adjusting to simulate resistance of an outdoor road with no gradient (namely a flat road), and another resistance source may be set to be a manually adjusting to add resistance of a road with a gradient or wind resistance when riding or to increase the training intensity.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A bicycle trainer adapted to be arranged with a bicycle to simulate riding a bicycle on an outdoor road, the bicycle trainer comprising:

a stand adapted to support the bicycle;

a roller pivoted to the stand and adapted to contact a bicycle wheel of the bicycle;

a first resistance source coupled to the roller and providing resistance to the bicycle wheel via the roller; and a second resistance source coupled to the roller and providing resistance to the bicycle wheel via the roller, wherein the first resistance source is an automatic adjusting resistance source, and the second resistance source is a manual adjusting resistance source.

2. The bicycle trainer as claimed in claim 1, wherein the first resistance source is a wind resistance type resistance source, a magnetic resistance type resistance source, a fluid resistance type resistance source or a friction type resistance source.

3. The bicycle trainer as claimed in claim 1, wherein the second resistance source is a wind resistance type resistance source, a magnetic resistance type resistance source, a fluid resistance type resistance source or a friction type resistance source.

4. The bicycle trainer as claimed in claim 1, wherein the first resistance source and the second resistance source are respectively located at two ends of the roller.

5. The bicycle trainer as claimed in claim 1, wherein the first resistance source, the second resistance source and the roller are coupled to the same rotation axis.

6. The bicycle trainer as claimed in claim 1, wherein the first resistance source comprises:

a magnetic fixing component fixed to the stand;

a non-magnetic metal rotating component coupled to the roller and mutually interacting with the magnetic fixing component to produce a magnetic resistance;

a restrictive rotating component coupled to the roller and construing a plurality of paths with the non-magnetic metal rotating component; and a plurality of rolling components respectively located in the plurality of paths and respectively moving along the plurality of paths due to the influence of a centrifugal force, allowing the non-magnetic metal rotating component to move with respect to the restrictive rotating component to adjust an interacting distance between the magnetic fixing component and the non-magnetic metal rotating component.

7. The bicycle trainer as claimed in claim 6, wherein the first resistance source further comprises:

a restoring component restoring the non-magnetic metal rotating component with respect to the restrictive rotating component.

8. The bicycle trainer as claimed in claim 6, wherein the first resistance source further comprises:

an inner cover fixed to the stand, wherein the magnetic fixing component is fixed to the inner cover; and an outer cover fixed to the restrictive rotating component.

9. The bicycle trainer as claimed in claim 1, wherein the second resistance source comprises:

a magnetism adjusting component movably attached to the stand;

a non-magnetic metal rotating component coupled to the roller and mutually interacting with the magnetism adjusting component to produce a magnetic resistance; and an adjustment assembly connected to the magnetism adjusting component, used to adjust the interacting area between the magnetism adjusting component and the non-magnetic metal rotating component.

10. The bicycle trainer as claimed in claim 9, wherein the resistance source further comprises:

an inner cover fixed to the stand, wherein the magnetism adjusting component is movably coupled to the inner cover; and an outer cover fixed to the non-magnetic metal rotating component.

11. A bicycle trainer adapted to be arranged with a bicycle to simulate riding a bicycle on an outdoor road, the bicycle trainer comprising:

a stand adapted to support the bicycle;

a roller pivoted to the stand and adapted to contact a bicycle wheel of the bicycle;

a first resistance source coupled to the roller and providing resistance to the bicycle wheel via the roller, wherein the first resistance source comprises:

a magnetic fixing component fixed to the stand;

a non-magnetic metal rotating component coupled to the roller and mutually interacting with the magnetic fixing component to produce a magnetic resistance;

a restrictive rotating component coupled to the roller and construing a plurality of paths with the non-magnetic metal rotating component; and a plurality of rolling components respectively located in the plurality of paths and respectively moving along the plurality of paths due to the influence of a centrifugal force, allowing the non-magnetic metal rotating component to move with respect to the restrictive rotating component to adjust an interacting distance between the magnetic fixing component and the non-magnetic metal rotating component; and a second resistance source coupled to the roller and providing resistance to the bicycle wheel via the roller.

12. The bicycle trainer as claimed in claim 11, wherein the second resistance source is a wind resistance type resistance source, a magnetic resistance type resistance source, a fluid resistance type resistance source or a friction type resistance source.

13. The bicycle trainer as claimed in claim 11, wherein the first resistance source, the second resistance source and the roller are coupled to the same rotation axis, and the first resistance source and the second resistance source are respectively located at two ends of the roller.

14. The bicycle trainer as claimed in claim 11, wherein the first resistance source further comprises:

a restoring component restoring the non-magnetic metal rotating component with respect to the restrictive rotating component.

15. The bicycle trainer as claimed in claim 11, wherein the first resistance source further comprises:

an inner cover fixed to the stand, wherein the magnetic fixing component is fixed to the inner cover; and an outer cover fixed to the restrictive rotating component.

16. A bicycle trainer adapted to be arranged with a bicycle to simulate riding a bicycle on an outdoor road, the bicycle trainer comprising:

a stand adapted to support the bicycle;

a roller pivoted to the stand and adapted to contact a bicycle wheel of the bicycle;

a first resistance source coupled to the roller and providing resistance to the bicycle wheel via the roller; and a second resistance source coupled to the roller and providing resistance to the bicycle wheel via the roller, wherein the second resistance source comprises:

a magnetism adjusting component movably attached to the stand;

a non-magnetic metal rotating component coupled to the roller and mutually interacting with the magnetism adjusting component to produce a magnetic resistance; and an adjustment assembly connected to the magnetism adjusting component, used to adjust the interacting area between the magnetism adjusting component and the non-magnetic metal rotating component.

17. The bicycle trainer as claimed in claim 16, wherein the first resistance source is a wind resistance type resistance source, a magnetic resistance type resistance source, a fluid resistance type resistance source or a friction type resistance source.

18. The bicycle trainer as claimed in claim 16, wherein the first resistance source, the second resistance source and the roller are coupled to the same rotation axis, and the first resistance source and the second resistance source are respectively located at two ends of the roller.

19. The bicycle trainer as claimed in claim 16, wherein the second resistance source further comprises:

an inner cover fixed to the stand, wherein the magnetism adjusting component is movably coupled to the inner cover; and an outer cover fixed to the non-magnetic metal rotating component.

* * * * *